US006601644B2

(12) United States Patent
Ozaki et al.

(10) Patent No.: US 6,601,644 B2
(45) Date of Patent: Aug. 5, 2003

(54) CORROSION PREVENTING LAYER FORMING METHOD

(75) Inventors: Tatsuo Ozaki, Okazaki (JP); Satomi Muto, Kasugai-gun (JP); Takaaki Sakane, Nagoya (JP); Hirokazu Yamaguchi, Tokyo (JP); Eiji Itaya, Tokyo (JP); Satoshi Tanaka, Tokyo (JP)

(73) Assignees: Denso Corporation, Kariya (JP); The Furukawa Electric Co., Ltd., Chiyoda (JP)

( * ) Notice: Subject to any disclaimer, the term of this patent is extended or adjusted under 35 U.S.C. 154(b) by 100 days.

(21) Appl. No.: 09/885,549

(22) Filed: Jun. 20, 2001

(65) Prior Publication Data

US 2002/0005278 A1 Jan. 17, 2002

Related U.S. Application Data

(63) Continuation of application No. PCT/JP00/07355, filed on Oct. 20, 2000.

(30) Foreign Application Priority Data

Oct. 21, 1999 (JP) ..... 11-300206

(51) Int. Cl.[7] ..... F28F 19/00
(52) U.S. Cl. ..... 165/134.1; 165/176; 29/890.052
(58) Field of Search ..... 165/133, 134.1, 165/176; 29/890.052

(56) References Cited

U.S. PATENT DOCUMENTS

| | | | | | |
|---|---|---|---|---|---|
| 3,960,208 | A | * | 6/1976 | Anthony et al. | 165/133 |
| 4,427,034 | A | * | 1/1984 | Nagata et al. | 138/145 |
| 5,011,547 | A | * | 4/1991 | Fujimoto et al. | 148/24 |
| 5,082,051 | A | * | 1/1992 | Ando | 165/110 |
| 5,246,064 | A | * | 9/1993 | Hoshino et al. | 165/146 |
| 5,720,340 | A | * | 2/1998 | Ohara et al. | 165/133 |
| 5,907,761 | A | * | 5/1999 | Tohma et al. | 165/133 |
| 6,167,953 | B1 | * | 1/2001 | Kobayashi et al. | 165/173 |
| 6,173,766 | B1 | * | 1/2001 | Nakamura et al. | 165/176 |
| 6,250,381 | B1 | * | 6/2001 | Nishishita | 165/175 |

FOREIGN PATENT DOCUMENTS

| | | |
|---|---|---|
| JP | A-59-71998 | 4/1984 |
| JP | A-1-142395 | 6/1989 |
| JP | A-9-152298 | 6/1997 |
| JP | A-10-152767 | 6/1998 |
| JP | A-11-142078 | 5/1999 |

* cited by examiner

*Primary Examiner*—Henry Bennett
*Assistant Examiner*—Terrell McKinnon
(74) *Attorney, Agent, or Firm*—Harness, Dickey & Pierce, PLC

(57) ABSTRACT

Radiator caps (266) and radiator tubes (211) are heat brazed with an ingot Z of a sacrificial material being disposed in the interior of a radiator tank main body (234), whereby, as the ingot Z of the sacrificial material is heated while being surrounded by the radiator tank main body (234), the evaporated sacrificial material is allowed to adhere to internal surfaces of the radiator tank main body (234) relatively uniformly, the sacrificial material so adhering to the internal surfaces being then allowed to be radiated into aluminum constituting the radiator tank main body (234) to thereby form an alloy layer (a corrosion preventing layer) containing therein the sacrificial material heavily on the internal surface of the radiator tank main body (234).

9 Claims, 13 Drawing Sheets

ENLARGEMENT OF PORTION C

ENLARGEMENT OF PORTION C

<BEFORE HEATING>

<AFTER HEATING>

CORROSION PREVENTING LAYER FORMING METHOD

CROSS-REFERENCE TO RELATED APPLICATIONS

This application is based upon and claims priority of Japanese Patent Application No. 11-300206, filed Oct. 21, 1999, the contents being incorporated therein by reference, and a continuation of PCT/JP00/07355 filed Oct. 20, 2000.

TECHNICAL FIELD

The present invention relates to a method for forming a corrosion preventing layer, on internal surfaces of a metallic tank filled with a fluid such as water, which is effective when applied to the production of a header tank of a radiator.

As is well known, a corrosion preventing layer is a layer constituted by a metal having a larger ionization tendency than that of a base material (a core material) to prevent corrosion of the base material (in this case, a tank main body).

DESCRIPTION OF RELATED ART

A duplex heat exchanger in which a radiator and a condenser are integrated into a single unit is disclosed, for example, in Japanese Unexamined Patent Publication (Kokai) No. 9-152298, and according to the disclosed invention, a header tank of a radiator (hereinafter, referred to as a radiator tank) and a header tank of a condenser (hereinafter, referred to as a condenser tank) are formed through extrusion of aluminum material.

Cooling water or coolant is filled in the radiator tank, and therefore a corrosion preventing layer needs to be formed on internal surfaces of the radiator tank. To this end, in general, an aluminum sheet material having a corrosion preventing layer of zinc formed on the surface thereof is pressed into shapes and the members so pressed into shapes are then joined together through brazing, whereby a header tank is provided which has the corrosion preventing layer formed on the internal surfaces thereof.

AS is described in the aforesaid unexamined patent publication, however, when an attempt is made to produce a radiator tank as an integral unit through extrusion, it is difficult to form a corrosion preventing layer on the internal surfaces of the tank and, therefore, a predetermined corrosion resistance has conventionally been secured by increasing the thickness of the sheet material used for radiator tanks. Since this increases the weight, as well as material cost of radiator tanks, there has been caused a problem that the production cost of radiators so produced is increased.

DISCLOSURE OF THE INVENTION

The present invention was made in view of these situations and an object thereof is to provide a method for forming a corrosion preventing layer on internal surfaces of a tank with ease.

With a view to attaining the object, according to a first aspect of the present invention, disposed within a tank main body (234) is a sacrificial material comprising a metal having a lower electric potential than that of the tank main body (234), so that the sacrificial material is heated in a state in which the same material is surrounded by the tank main body (234).

In this construction, the evaporated sacrificial material is allowed to adhere to internal surfaces of the tank main body (234) relatively uniformly without being radiated out of the tank main body (234). Then, the sacrificial material so adhering to the internal surfaces is dispersed into a metal constituting the tank main body (234), whereby an alloy layer (a corrosion preventing layer) containing the sacrificial material heavily is formed over the internal surface of the tank main body (234).

Consequently, according to the present invention, the relatively uniform corrosion preventing layer can be formed on the internal surfaces of the tank main body (234) with ease.

According to another aspect of the invention, the tank main body (234) comprises at least two parts (233, 235), a sacrificial material constituted by a metal having a lower electric potential than that of the tank main body (234) is disposed on part of an internal surface of at least one of the two parts (233, 235), and the two parts (233, 235) are assembled together so as to surround the sacrificial material so disposed so that the sacrificial material is heated in the surrounded state.

In this construction, the evaporated sacrificial material is allowed to adhere to the internal surfaces of the tank main body (234) relatively uniformly without being radiated out of the tank main body (234). Then, the sacrificial material so adhering to the internal surfaces is dispersed into the metal constituting the tank main body (234), whereby an alloy layer (a corrosion preventing layer) containing the sacrificial material is heavily formed over the internal surface of the tank main body (234).

Consequently, according to the present invention, the relatively uniform corrosion preventing layer can be formed on the internal surfaces of the tank main body (234) with ease.

According to a further aspect of the invention, there are provided a plurality of tubes (211) through which fluid is allowed to flow and metallic header tanks (230) disposed at longitudinal ends of the plurality of tubes (211) for communication therewith. The header tank (230) comprises a tank main body (234) extending in a direction normal to the longitudinal direction of the tubes (211) and caps (236) for closing longitudinal ends of the tank main body (234), and the tank main body (234) and the caps (236) are joined to each other through heat brazing with a sacrificial material comprising a metal having a lower electric potential than that of the tank main body (234) being disposed in the interior of the tank main body (234).

In this construction, as described previously, since a relatively uniform corrosion preventing layer can be formed on the internal surfaces of the tank main body (234), a heat exchanger can be realized which is light in weight as well as low in production cost while the corrosion resistance of the heat exchanger is maintained.

According to a still further aspect of the invention, there are provided a plurality of radiator tubes (211) through which cooling water or coolant is allowed to flow, metallic radiator header tanks (230) disposed at longitudinal ends of the plurality of tubes (211) for communication therewith, a plurality of radiator tubes (111) through which refrigerant is allowed to flow, and metallic radiator header tanks (120) disposed at longitudinal ends of the plurality of radiator tubes (111) for communication therewith. The radiator header tank (230) comprises a radiator tank main body (234) extending in a direction normal to the longitudinal direction of the radiator tubes (211) and radiator caps (236) for closing longitudinal ends of the tank main body (234), and the radiator header tank (120) comprises a radiator tank main body (123) extending in a direction normal to the longitudinal direction of the radiator tubes (111) and radiator caps (124) for closing longitudinal ends of the radiator tank main body (123). Both the tank main bodies (123, 234) are made integral with each other through extrusion or drawing, and furthermore the radiator tank main bodies (123, 234) and the radiator caps (236) are joined to each other through heat brazing with a sacrificial material comprising a metal having a lower electric potential than that of the radiator tank main body (234) being disposed in the interior of the radiator tank main body (234).

In this construction, since a relatively uniform corrosion preventing layer can be formed only in the radiator tank (230) with ease, a duplex heat exchanger can be realized which is light in weight as well as low in production cost while the corrosive resistance of the duplex heat exchanger is maintained.

Note that reference numerals in parentheses after the respective means are one example denoting the relationship between those means and corresponding specific means described in embodiments which will be described later.

The present invention will be understood more clearly with reference to the accompanying drawings and description of preferred embodiments below.

BEST MODE FOR CARRYING OUT THE INVENTION

First Embodiment

A first embodiment relates to an embodiment in which the present invention is applied to a duplex heat exchanger comprising a condenser 100 for cooling refrigerant circulating within a vehicle refrigerating cycle and a radiator 200 for cooling engine cooling water or coolant which are made integrally with each other. The duplex heat exchanger (hereinafter, referred simply to as a heat exchanger) according to the embodiment will be described below.

Figure 1:
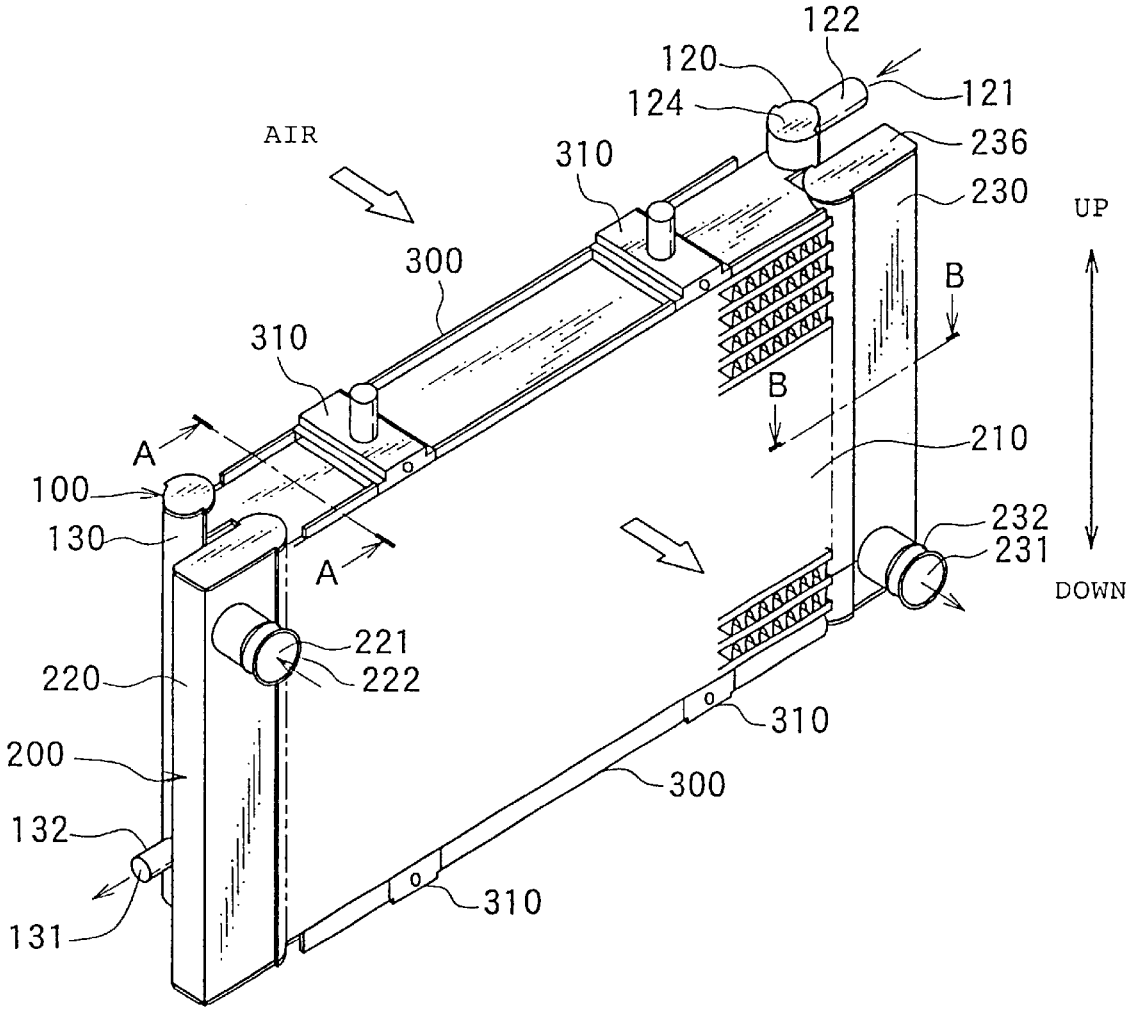
FIG. 1 is a perspective view of a duplex heat exchanger according to a first embodiment of the present invention.
Figure 2:
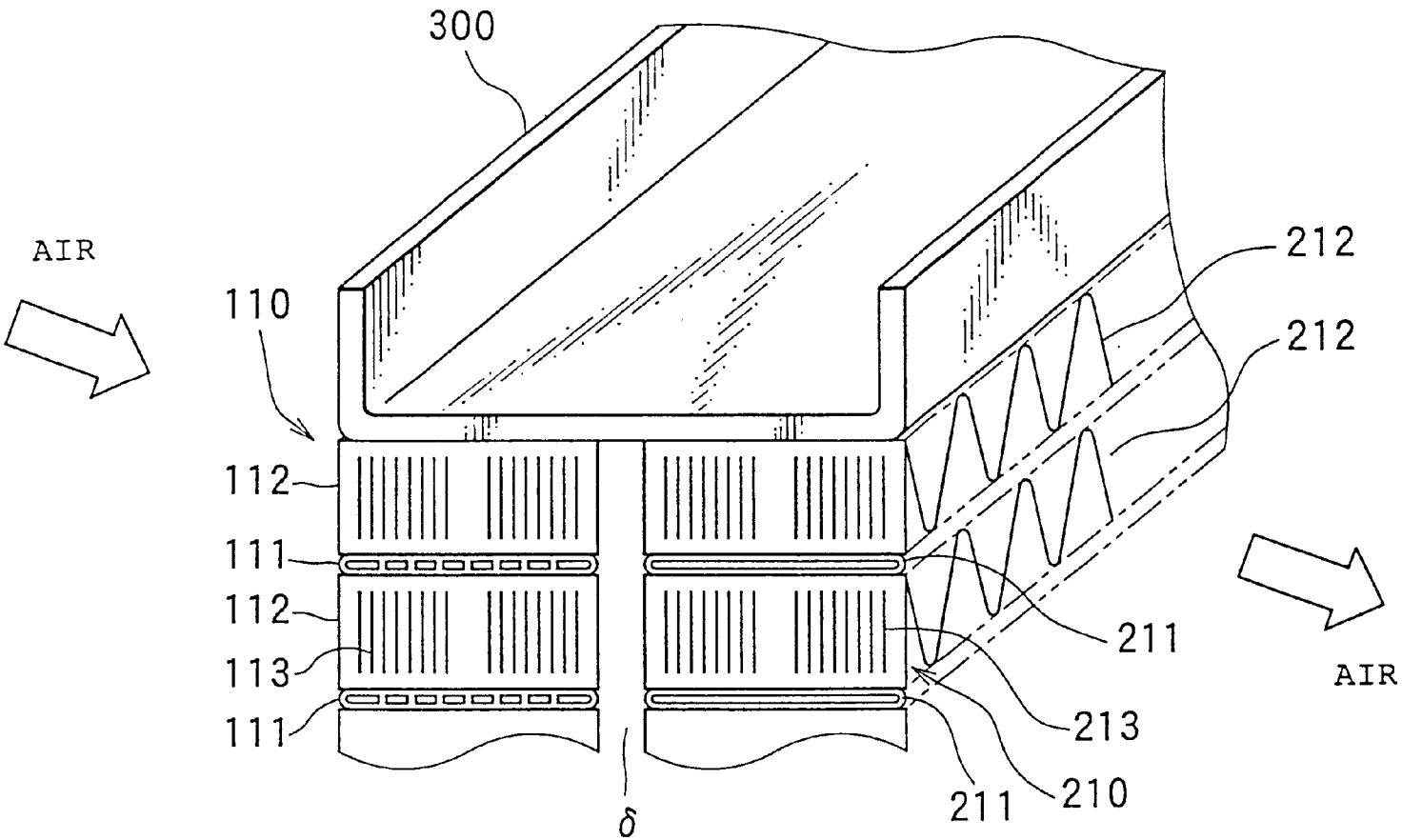
FIG. 2 is a cross-sectional view taken along the line A—A of FIG. 1.

FIG. 1 is a perspective view of the heat exchanger according to the embodiment, and FIG. 2 is a cross-sectional view taken along the line A—A of FIG. 1. Reference numeral 110 denotes a condenser core portion of the condenser 100 and reference numeral 210 denotes a radiator core of the radiator 200.

As shown in FIG. 2, the condenser core portion 110 comprises condenser tubes 111 formed flat as passages for refrigerant and corrugated (waved) fins 112 which are brazed to the condenser tubes 111.

On the other hand, the radiator core 210 has a similar construction to that of the condenser core portion 110 and comprises radiator tubes 211 disposed in parallel with the condenser tubes 111 and fins 212.

Both the core portions 110, 210 are arranged in series in a direction in which air flows with a gap being provided between the core portions for cutting off heat conduction therebetween.

In addition, louvers 113, 213 are formed in the fins 112, 212, respectively, for promoting heat exchange, and the louvers 113, 213 are formed in the fins through roll forming at the same time as the fins 112, 212 are formed.

In addition, reference numeral 300 denotes a side plate constituting a reinforcement member for both the core portions 110, 210, and this core plate 300 is, as shown in FIG. 1, disposed along side edges of both the core portions 110, 210. As shown in FIG. 2, the side plate 300 is integrally formed of a sheet aluminum into a shape having a U-shaped cross section. Note that in FIG. 1, reference numeral 310 denotes a bracket for attaching the heat exchanger to an automotive vehicle.

In addition, a first radiator tank 220 for distributing coolant to the respective radiator tubes 211 is disposed at one of ends of the radiator core portion 210 where the side plates 300 are not disposed, and a second radiator tank 230 for recovering the coolant from which heat has been removed after heat exchange.

An inlet 221 is provided at an upper end portion of the first radiator 220 for allowing coolant from the engine to flow therefrom into the first radiator 220, whereas an outlet 231 is provided at a lower end portion of the second radiator 230 for allowing coolant to flow out therefrom toward the engine.

In addition, reference numerals 222, 232 denote joining pipes, respectively, for joining external piping (not shown) to the respective radiator tanks 220, 230, and these joining pipes 222, 232 are joined to the respective radiator tanks 220, 230 through brazing.

Furthermore, reference numeral 120 denotes a first condenser tank for distributing refrigerant in the condenser core portion 110 to the respective condenser tubes 111, and reference numeral 130 denotes a second condenser tank of the condenser core portion 110 for recovering refrigerant from which heat has been carried away after heat exchange (condensation).

Reference numeral 121 denotes an inlet for allowing refrigerant discharged from a compressor (not shown) in the refrigerating cycle to flow therefrom into the first condenser tank 120, whereas reference numeral 131 denotes an outlet for allowing refrigerant from which heat has been carried away after heat exchange (condensation) to flow out therefrom toward an expansion valve (not shown).

Note that reference numerals 122, 132 denote, respectively, joining pipes for joining external piping (not shown) to both the condenser tanks 120, 130, and these joining pipes 122, 132 are joined to the respective condenser tanks 120, 130 through brazing.

Figure 3:
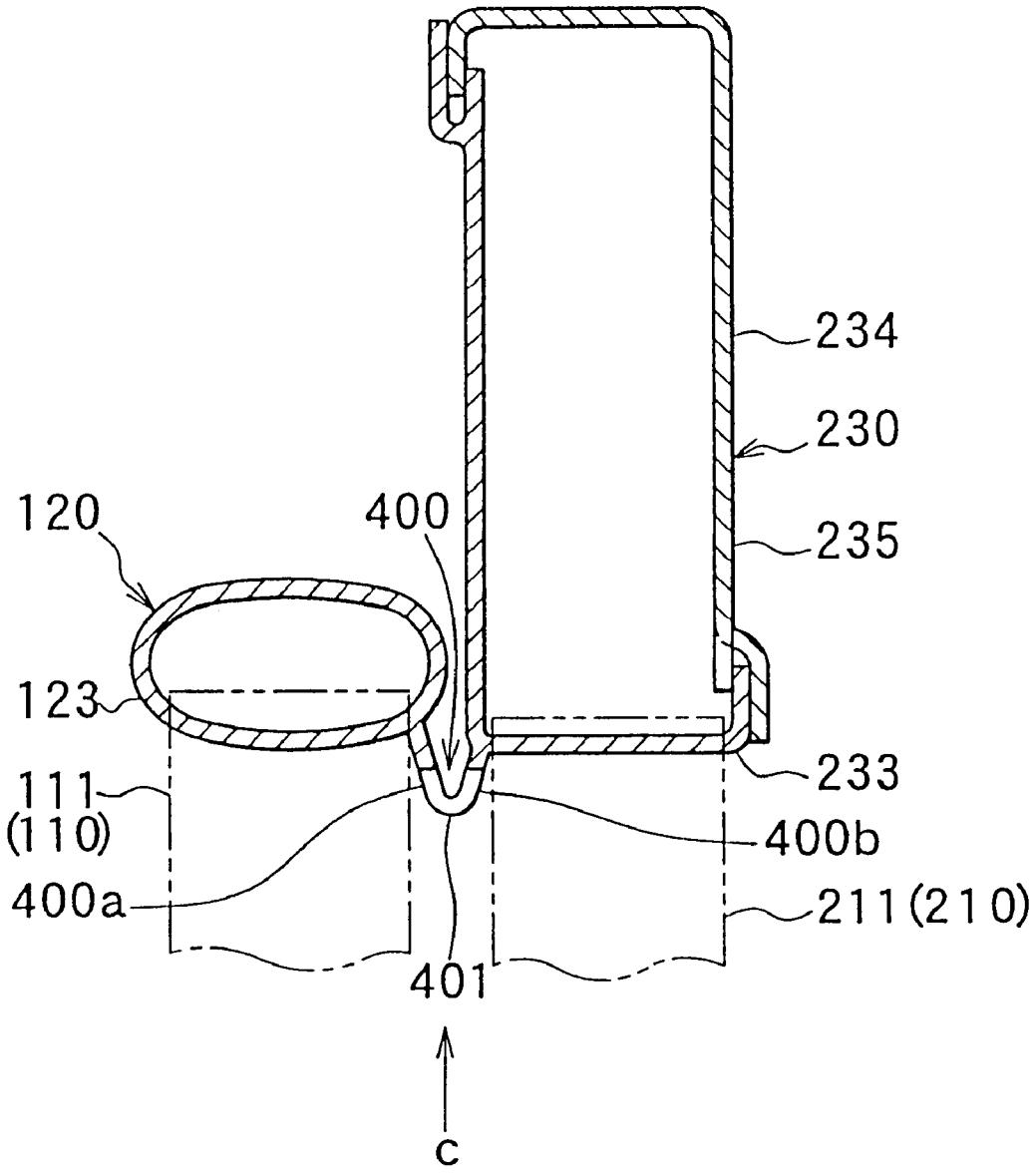
FIG. 3 is a cross-sectional view taken along the line B—B of FIG. 1.

As shown in FIG. 3, the second radiator tank 230 are constituted by a radiator core plate 233 made of aluminum which connects to the radiator tubes 211, a radiator tank member 235 made of aluminum which connects to the radiator core plate 233 so as to form an angular pipe-like radiator tank main body 234 which is to be filled with coolant and radiator tank caps 236 for closing longitudinal ends of the radiator tank main body 234, and these members 233, 235, 236 are integrally connected to each other through brazing.

On the other hand, the first condenser tank 120 is constructed so as to have a tubular condenser tank main body (a radiator tank main body) 123 made of aluminum and having an oval cross section which connects to the condenser tubes 111 and forms the space of the first condenser tank 120 and condenser caps (radiator caps) 124 (refer to FIG. 1) for closing longitudinal ends of the condenser tank main body 123.

Figure 4:
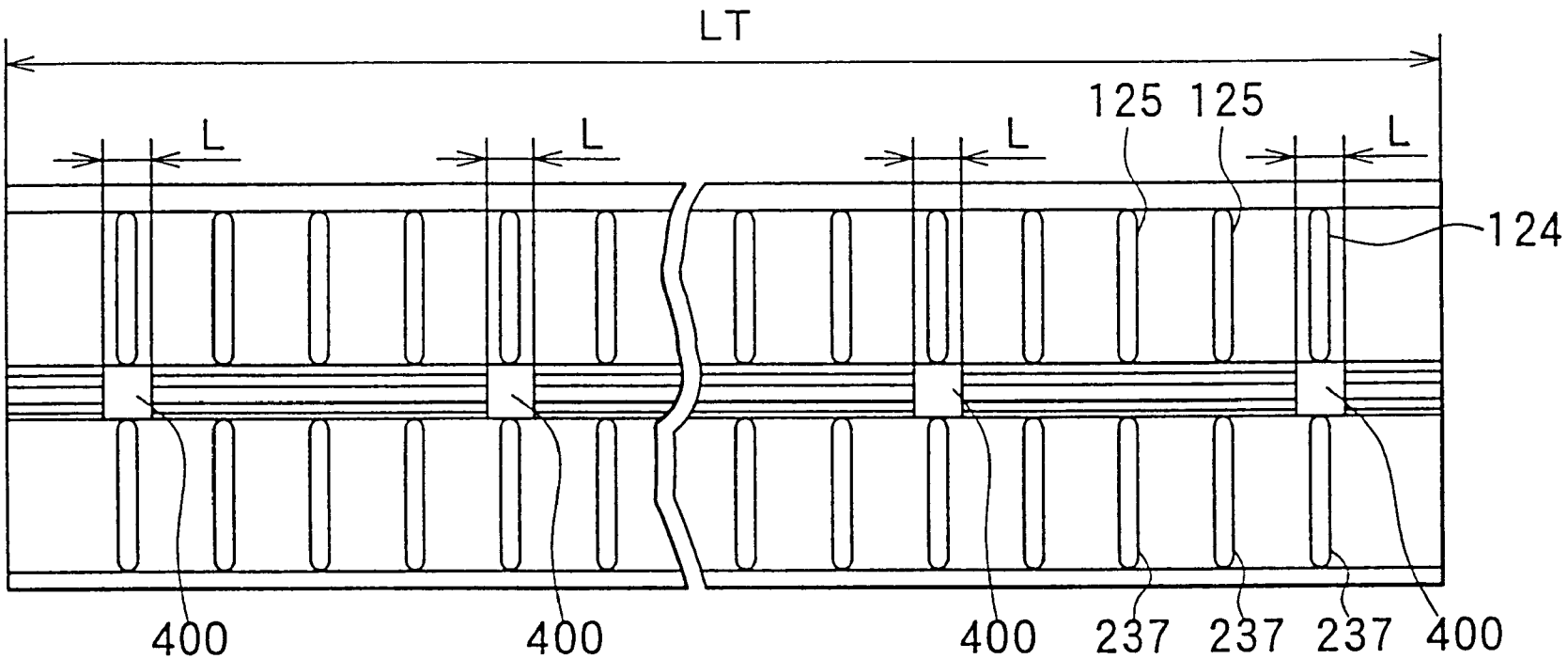
FIG. 4 is a view as viewed in a direction indicated by an arrow C in FIG. 3.

As shown in FIG. 4, flat condenser tube inserting holes (first inserting holes) 125 are formed in the condenser tank main body 123 (the first condenser tank 120) so that the condenser tubes 111 are inserted thereinto, whereas flat radiator tube inserting holes (second inserting holes) 237 are formed in the radiator core plate 233 (the second radiator tank 230) so that the radiator tubes 211 are inserted thereinto.

In addition, both the tanks 120, 230 (the first condenser tank 120 and the radiator core plate 233) are made integral with (connect to) each other at a connecting portion 400 where a major axial end of the condenser tube inserting hole 125 connects to a major axial end of the radiator tube inserting hole 237.

As shown in FIG. 3, the connecting portion 400 is bent into a U or V shape so as to protrude toward both core portions 110, 210, and is formed such that at least a distal end (a bent portion) 401 of the connecting portion 400 is positioned closer to the condenser core portion 110 than to the first condenser tank 120 as viewed from an upstream side of the air flow.

Additionally, the cross-sectional area of the condenser tank main body 123 and the cross-sectional area of the radiator core plate 233 are selected such that they become substantially equal to each other, and the condenser tank main body 123 and the radiator core plate 233 are formed integrally through extrusion or drawing together with the connecting portion 400.

Figure 5:
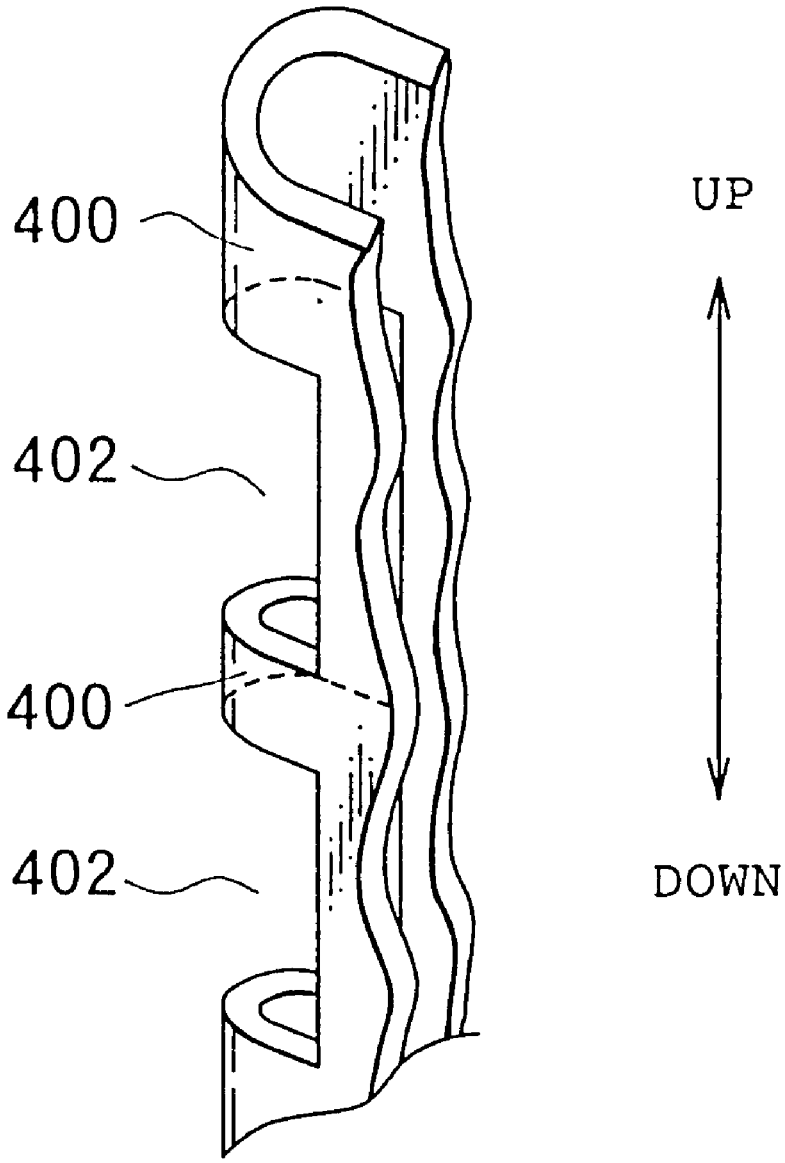
FIG. 5 is a perspective view showing a connecting portion of the duplex heat exchanger according to the first embodiment.

Then, after the condenser tank main body 123 and the radiator core plate 233 have been formed through extrusion or drawing, the distal end 401 of the connecting portion 400 is partially removed through press cutting, whereby, as shown in FIG. 5, a plurality of cut-away portions 402 are formed between both the tanks 110, 210 dispersively in the longitudinal direction of both tanks 110, 210.

Note that in this embodiment the cut-away portions 402 are formed such that a ratio ($\Sigma L/LT$) between the total sum of dimensions L (refer to FIG. 4) of portions of the connecting portion 400 which are parallel to the longitudinal direction of both the tanks 120, 230 and the longitudinal dimension LT of both the tanks 120, 230 becomes 0.5 or smaller.

Since the first radiator tank 220 and the second condenser tank 130 are similar in construction to the second radiator tank 230 and the first condenser tank 120, in the following description, unless otherwise stated, when used, the radiator tank 230 is meant to include both the radiators 220, 230, and similarly, when used, the condenser tank is meant to include both the condenser tanks 120, 130.

Next, a method for producing the condenser tank 120 and the radiator tank 230 will be described.

Figure 6A:
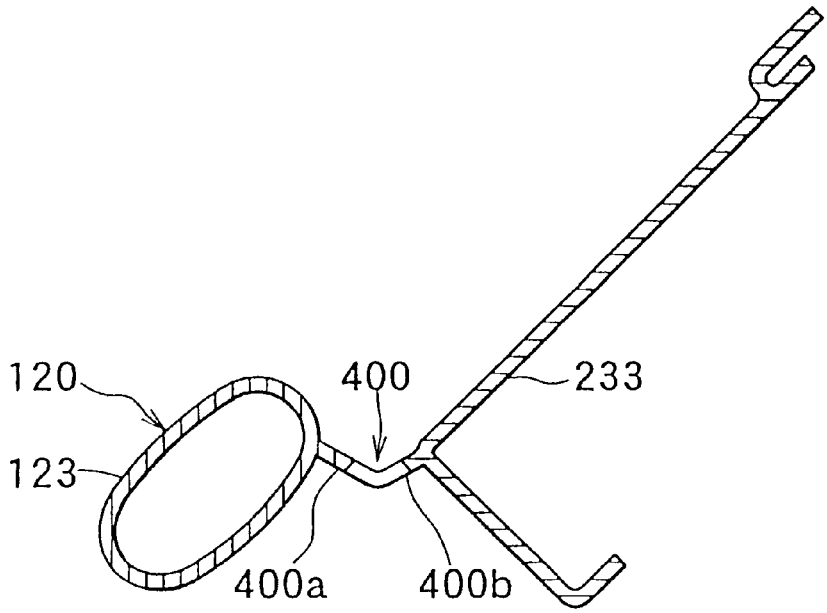
FIGS. 6A and 6B are schematic explanatory views showing a production method of the duplex heat exchanger according to the first embodiment of the present invention.

Firstly, the condenser tank main body 123 and the radiator core plate 233 are formed integrally with each other of an aluminum material through extrusion or drawing. Note that in this process, as shown in FIG. 6A, a portion corresponding to the connecting portion 400 is not bent at an acute angle into a U or a V shape but is bent at substantially 90 degrees.

Figure 6B:
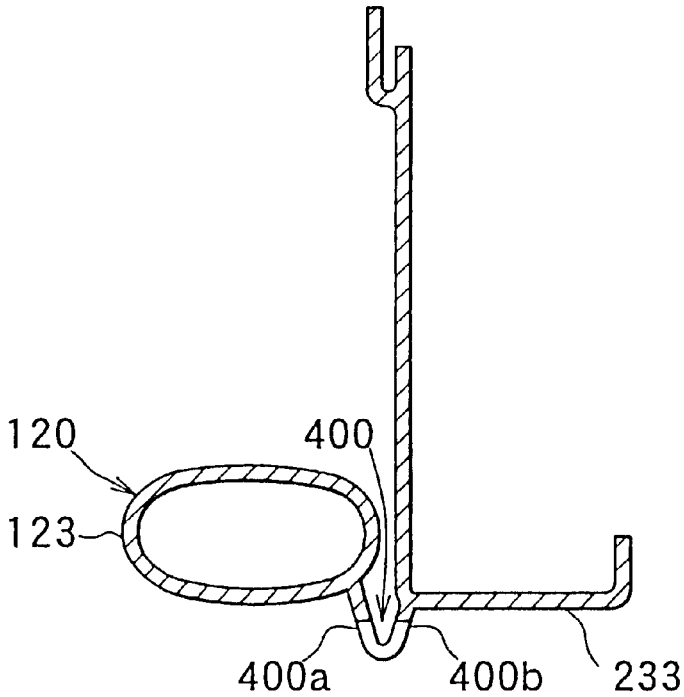

Next, the condenser tube inserting holes 125 are formed in the condenser tank main body 123 through machining. Then, the connecting portion 400 is partially press cut and removed to thereby form the cut-away portions 402, and after the radiator tube inserting holes 237 are formed, as shown in FIG. 6B, the connecting portion 400 is press bent further into the U or V shape.

Figure 7A:
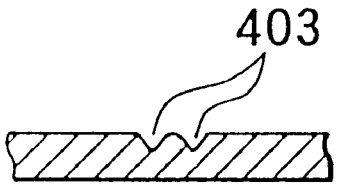
FIGS. 7A and 7B are cross-sectional views showing notches formed in a position corresponding to a distal end of the connecting portion.
Figure 7B:
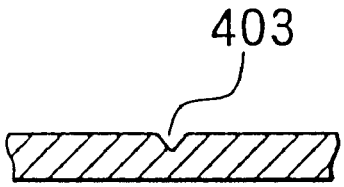
Figure 7C:
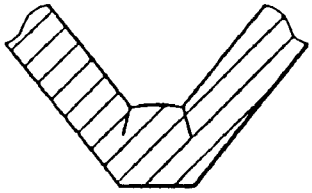
FIGS. 7C and 7D are cross-sectional views showing states where the notched portions shown in FIGS. 7A and 7B, respectively, are bent.
Figure 7D:
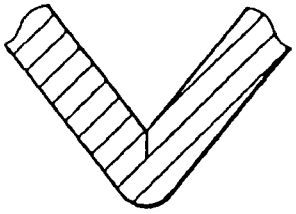

Additionally, in press bending the connecting portion 400, provision of a notch or notches 403 in a location corresponding to the distal end portion 401 of the connecting portion, as shown in FIG. 7A or 7B, facilitates the bending of the location corresponding to the connecting portion 400, as shown in FIG. 7C or 7D.

Figure 8A:
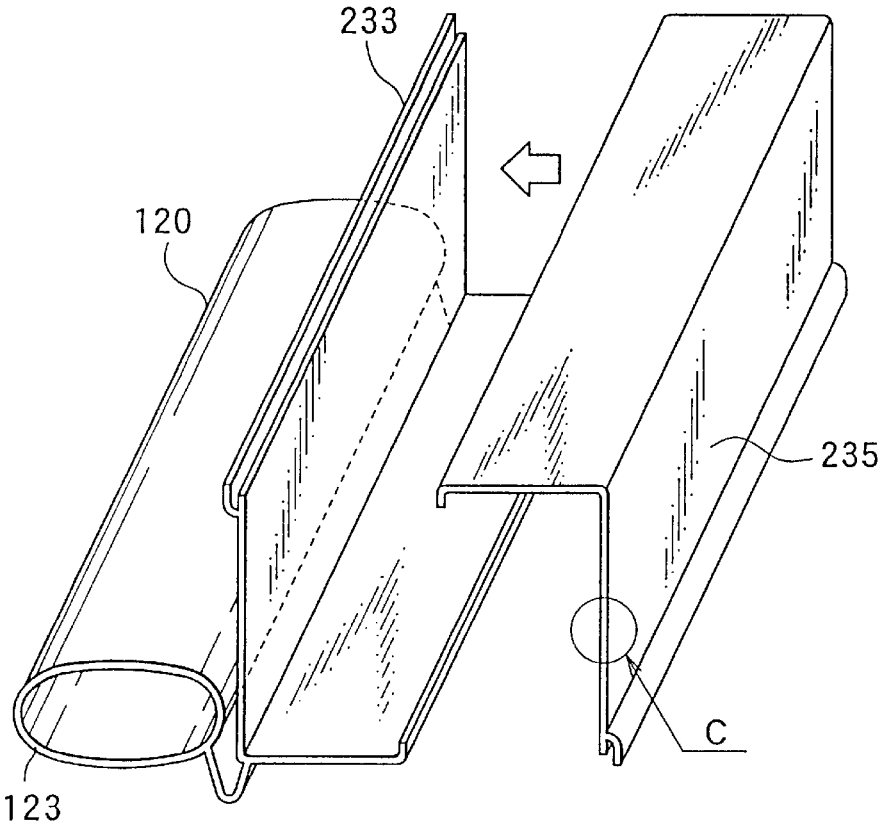
FIG. 8A is an exploded view of the duplex heat exchanger according to the first embodiment of the present invention.
Figure 8B:
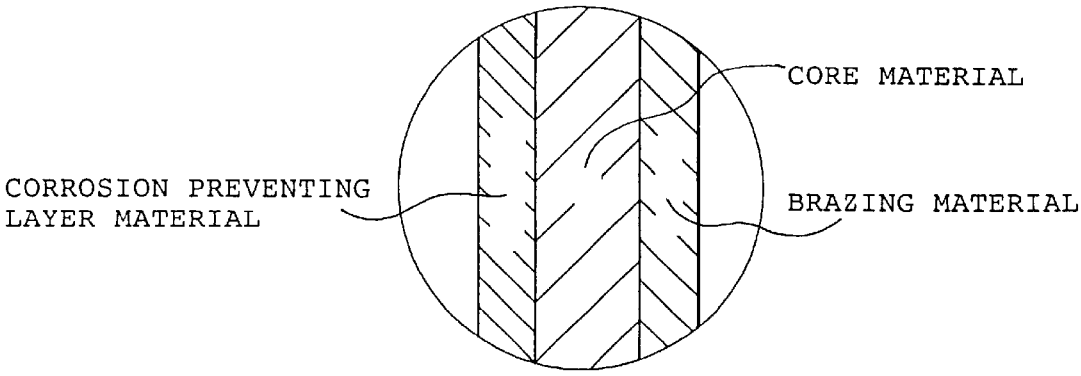
FIG. 8B is an enlarged view of a portion C shown in FIG. 8A.

On the other hand, in the radiator tank member 235, a brazing material is clad on one side of an aluminum core material (a base material), as shown in FIG. 8B, whereas a sacrificial layer material comprising a sacrificial material (zinc in this embodiment) having a lower electric potential than that of the core material is disposed to be clad on the other side of the core material, and when the brazing sheet material is press bent in a predetermined fashion, the radiator tank member 235 is formed so as to have an L-shaped cross section. Note that as this occurs, the radiator tank member 235 is press bent such that the side thereof where the sacrificial layer material is clad constitutes an internal surface of the radiator tank main body 234.

Next, the radiator tank member 235, the radiator core plate 233, both the tubes 111, 211, both the fins 112, 212, both the caps 124, 236 and the side plates 300 are assembled and fixed together as shown in FIGS. 1, 3, 8A and are then heated, in an oven, so as to be joined together using a Nocolock(™) brazing method.

Here, the heating temperature inside the oven is a temperature which is higher than the fusing points of the brazing material and the sacrificial layer material (zinc) and lower than that of the aluminum used as the core material. To be specific, since the fusing point of the core material ranges from 650 degrees C. to 660 degrees C and those of the brazing material and the sacrificial layer material (zinc) are about 570 degrees C. and about 420 degrees C., respectively, the heating temperature is about 600 degrees C., the heating time being about 10 minutes after the heating temperature is reached although this depends upon the size of the heat exchanger heated.

Note that the Nocolock(™) brazing method is, as is well known, referred to as a method in which a flux for removing an oxide layer is applied to an aluminum material on which a brazing material is clad, and thereafter, the aluminum material is heat brazed in an atmosphere of an inert gas such as nitrogen.

Next, features of the first embodiment will be described.

According to this embodiment, since the radiator tank member 235 and the radiator core plate 233 are heated after they have been assembled together, the corrosion preventing material (the sacrificial material) disposed and clad on the radiator tank member 235 is evaporated in a state in which the sacrificial layer material is confined in the radiator tank main body 234 constituted by the radiator tank member 235 and the radiator core plate 233.

Due to this, the evaporated sacrificial material (zinc) adheres to the internal surfaces of the radiator tank main body 234 including the internal surface of the radiator core plate 233 relatively uniformly without being radiated out of the radiator tank main body 234. Then, the sacrificial material (zinc) so adhering to the internal surfaces is radiated into the aluminum constituting the radiator tank main body 234, whereby an alloy layer (a corrosion preventing layer) containing the sacrificial material is heavily formed over the internal surface of the tank main body 234.

As has been described heretofore, according to the embodiment, the relatively uniform corrosion preventing layer can be formed on the internal surfaces of the radiator tank main body 234 with ease. Thus, a heat exchanger can be realized which is light in weight and low in production cost while the corrosion resistance of the heat exchanger is maintained.

In addition, the radiator tank main body 234 is heated as a closed space by closing the openings of the radiator tank main body 234 with the radiator tank caps 236, the evaporated sacrificial material is assuredly prevented from being radiated out of the radiator tank main body 234, and the corrosion preventing layer can also be formed on the internal surfaces of the radiator caps 236 with ease. Consequently, it is ensured that the corrosion preventing layer can be formed on the internal surfaces of the radiator tank 230 without increasing the amount of the sacrificial material (zinc) uselessly.

Additionally, since the corrosion preventing layer is formed at the same time as heating for brazing is implemented, no separate heating process is required for forming the corrosion preventing layer, whereby man hours for producing the heat exchanger can be reduced, and since the evaporated sacrificial material (zinc) enters the interior of the radiator tubes 211, the corrosion preventing layer can also be formed on internal surfaces of the radiator tubes 211.

Second Embodiment

Figure 9:
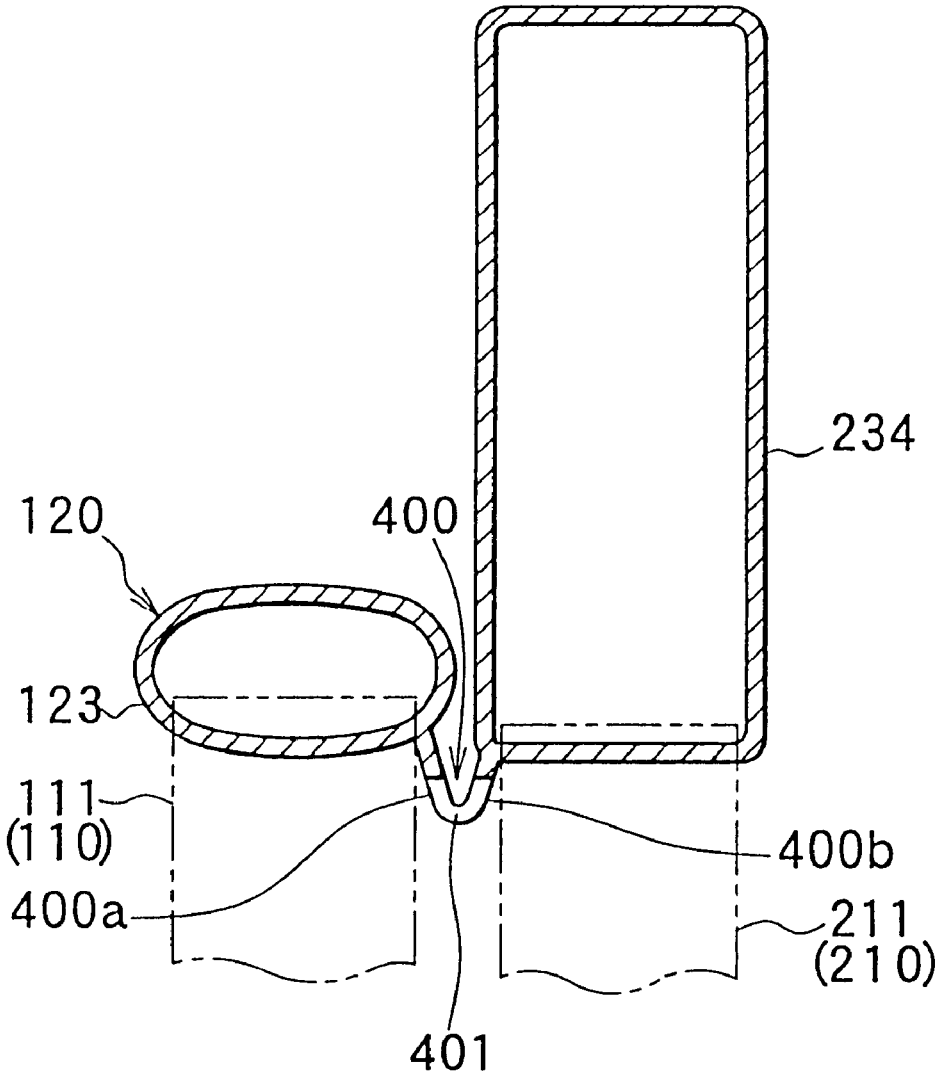
FIG. 9 is a cross-sectional view of a portion of a duplex heat exchanger according to a second embodiment of the present invention which corresponds to the cross section taken along the line B—B of FIG. 1.

While the radiator tank main body 234 is constituted by the two parts such as the radiator tank member 235 and the radiator core plate 233 in the first embodiment, in a second embodiment, as shown in FIG. 9, a radiator tank main body 234 is formed as an integral unit of an aluminum material through extrusion or drawing.

A method for forming a corrosion preventing layer on internal surfaces of the radiator tank main body 234 according to the second embodiment will be described below.

Figure 10:
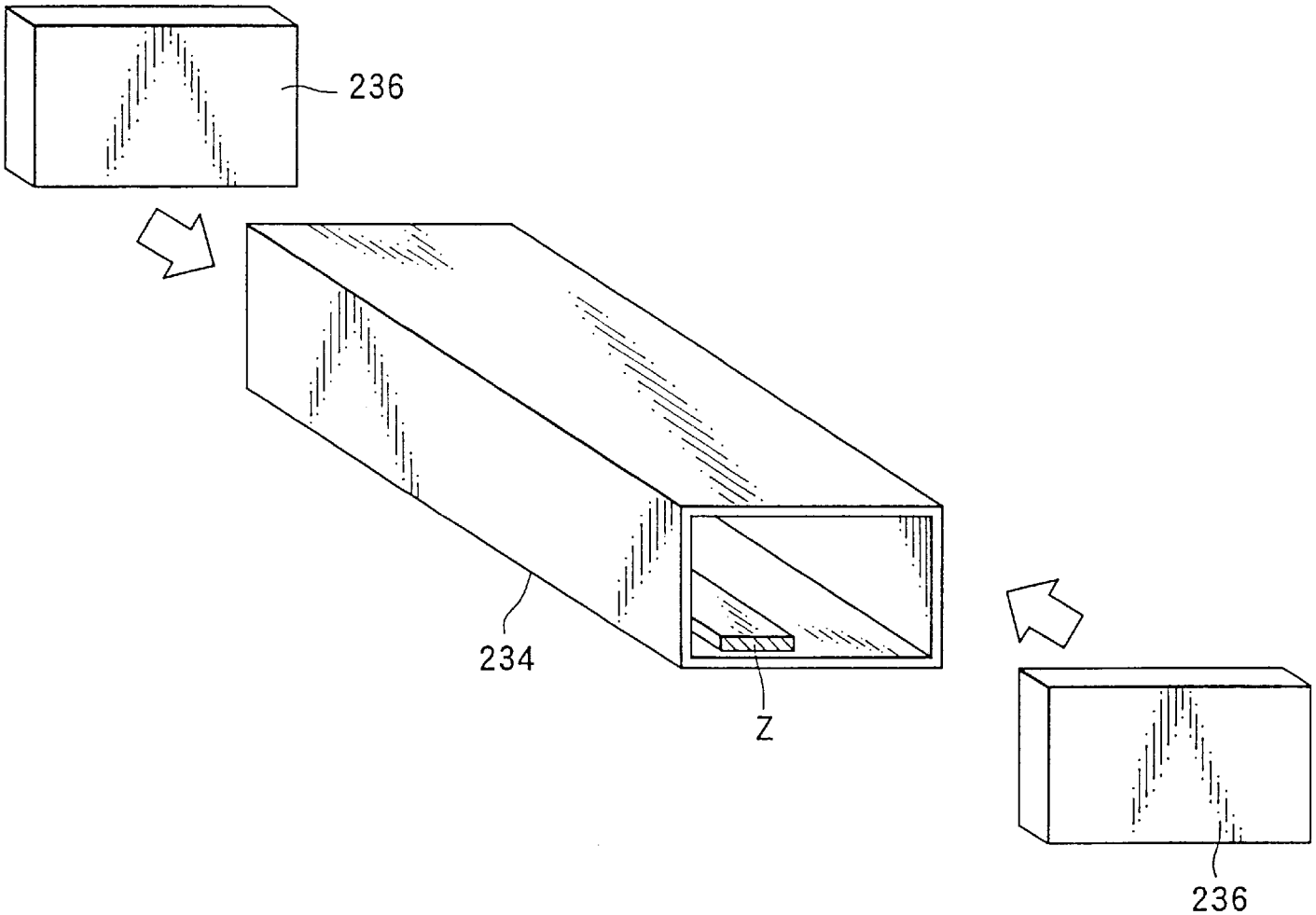
FIG. 10 is an exploded view of the duplex heat exchanger according to the first embodiment of the present invention.

Firstly, as shown in FIG. 10, an ingot Z of a sacrificial material (a zinc alloy containing zinc as a main constituent) is disposed inside the radiator tank main body 234. Similarly to the first embodiment, the radiator tank main body 234 is heat brazed after the other components such as radiator tank caps 266 and radiator tubes 211 have been tentatively assembled thereto.

Note that in this embodiment, as no brazing material is clad on the radiator tank caps 266, after the brazing material is applied to portions where the radiator tank caps 266 and the radiator tubes 211 are joined, heat brazing is carried out.

Figure 11A:
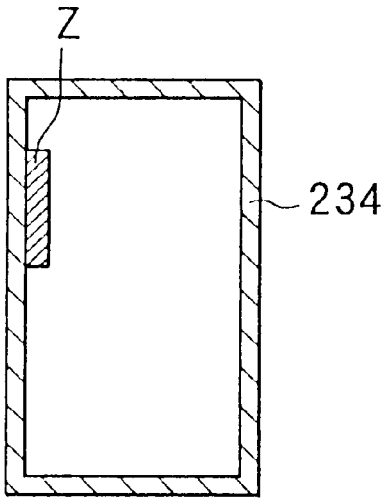
FIGS. 11A and 11B are explanatory views explaining the formation of a corrosion preventing layer.
Figure 11B:
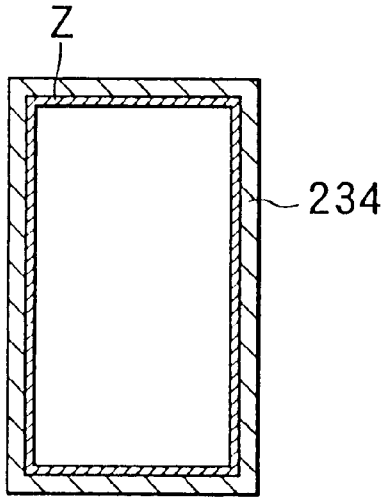

In this construction, since the ingot Z of sacrificial material is to be heated while being entirely surrounded by the radiator tank main body 234, as with the first embodiment, the evaporated sacrificial material (zinc) is allowed, as shown in FIGS. 11A and 11B, to adhere to the internal surfaces of the radiator tank main body 234 relatively uniformly without being radiated out of the radiator tank main body 234.

Then, the sacrificial material (zinc) so adhering to the internal surfaces is allowed to be radiated into aluminum constituting the radiator tank main body 234 to thereby form an alloy layer (a corrosion preventing layer) containing the sacrificial material (zinc) heavily on the internal surfaces of the radiator tank main body 234.

In contrast to the radiator tank 230 which is filled with coolant and hence requires a corrosion preventing layer to be formed on the internal surfaces thereof, no corrosion preventing layer is required to be formed on the internal surfaces thereof as the condenser tank 120 is filled with refrigerant.

On the other hand, since both the tanks 123, 234 are integrally formed through extrusion or drawing in this embodiment, as described in the "Description of the Related Art", it is difficult to form a corrosion preventing layer on the internal surfaces of the radiator tank main body 234.

With a method according to this embodiment, however, as described above, since the corrosion preventing layer can be formed only on the internal surfaces of the radiator tank main body 234 with ease, the embodiment is effective even if it is applied to a heat exchanger in which both the tanks 123, 234 are formed integrally through extrusion or drawing.

Other Embodiments

Figure 12:
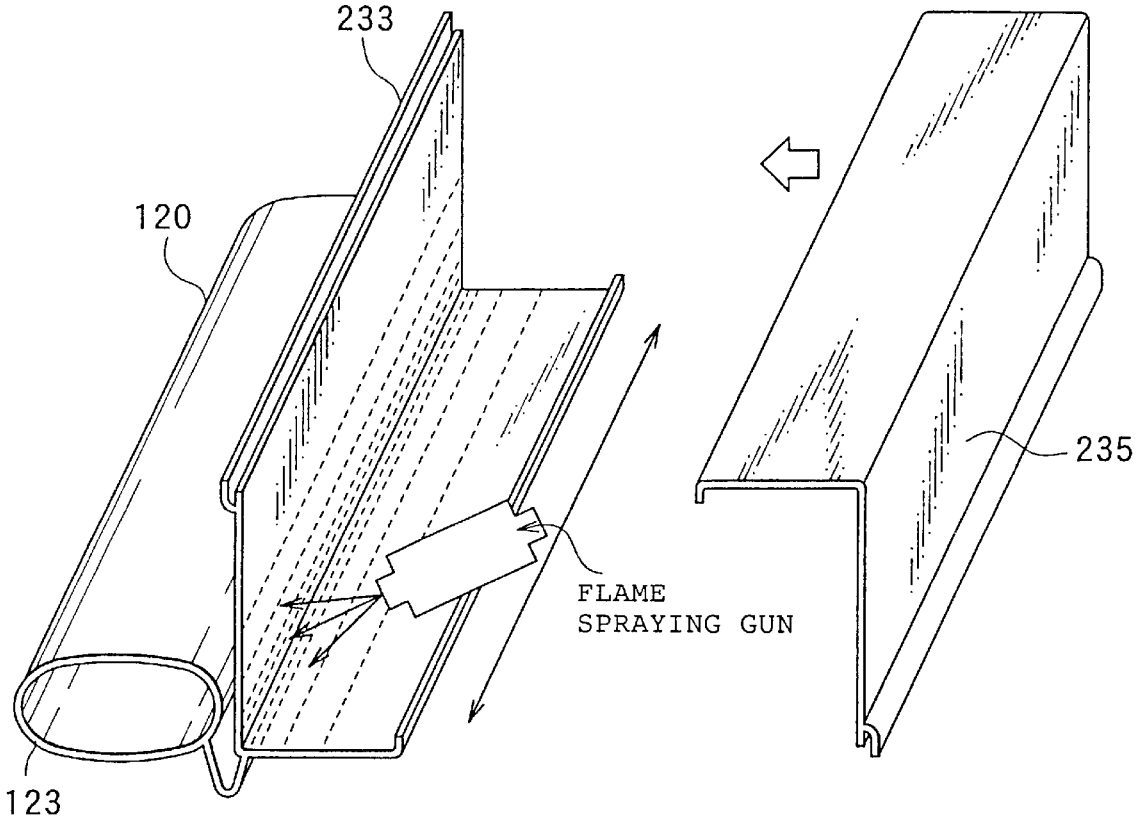
FIG. 12 is an explanatory view showing a modification to the present invention.

While the press formed product (the radiator tank member 235) on which the sacrificial material (the sacrificial material layer) is disposed and clad is used in the first embodiment, both the radiator tank member 235 and the radiator core plate 233 may be formed of an aluminum material through extrusion or drawing and, as shown in FIG. 12, the sacrificial material may be flame sprayed on at least one of the radiator tank member 235 and the radiator core plate 233 to dispose the sacrificial material thereon.

Note that although it is difficult to provide a uniform adhesion of the sacrificial material through flame spraying, as described above, since the sacrificial material adheres to the internal surfaces of the radiator tank main body 234 relatively uniformly when evaporated, even if the sacrificial material does not adhere uniformly at the time of flame spraying, a corrosion preventing layer can be formed substantially uniformly on the internal surfaces of the radiator tank main body 234.

In addition, while Nocolock(™) brazing is used in the above embodiments, the present invention can be used with a vacuum brazing method.

Additionally, while the corrosion preventing layer is formed on the internal surfaces of the angular pipe-like radiator tank main body 234 in the above embodiments, the present invention is not limited thereto but may be applied to a case where a corrosion preventing layer is formed on a round pipe-like tank, pipe, tube or the like.

Figure 13:
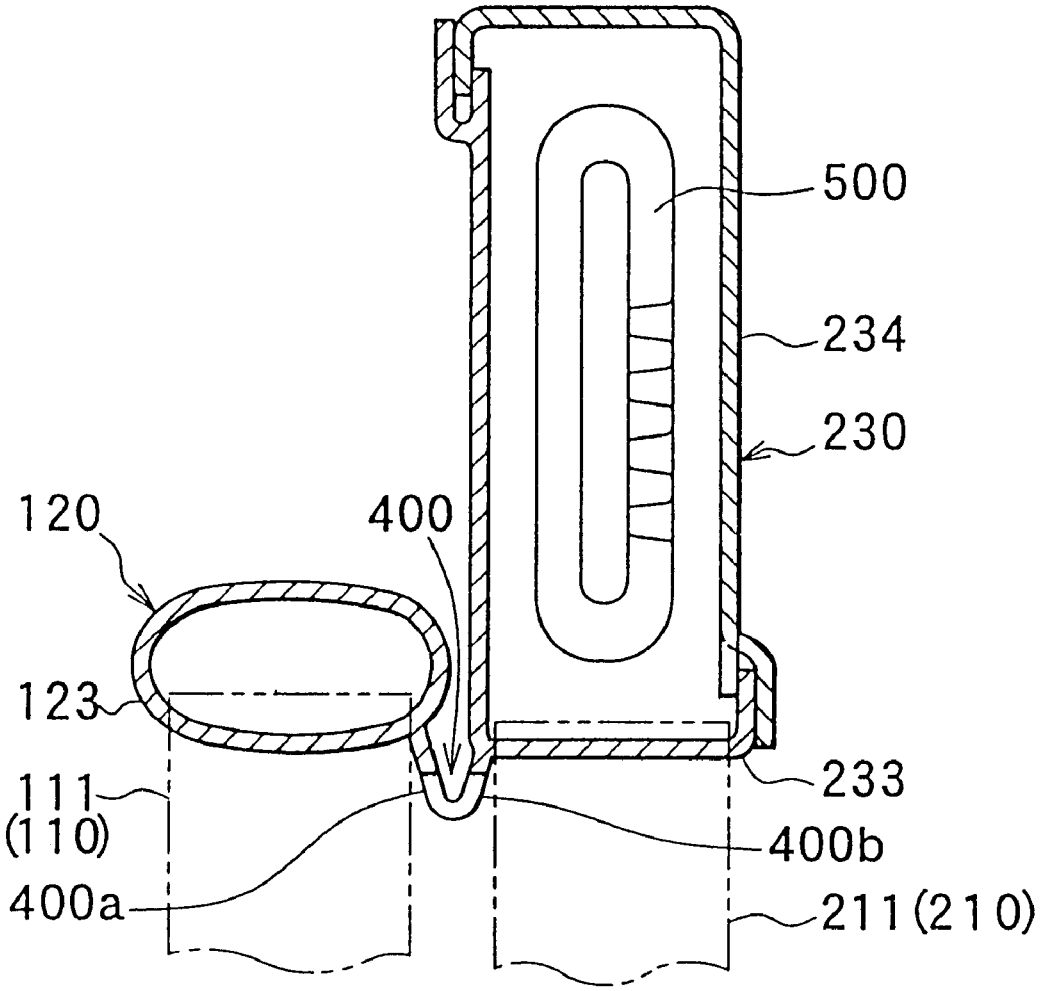
FIG. 13 is a cross-sectional view showing the modification to the present invention which corresponds to the cross section taken along the line B—B of FIG. 1.

In addition, the heat exchangers according to the present invention may be applied, as shown in FIG. 13, to a duplex heat exchanger in which a radiator tank 230 incorporates therein an oil cooler 500 for cooling lubricating oil such as engine oil and transmission oil.

Moreover, while it has been described in the above embodiments as being applied to the duplex heat exchanger in which the condenser and the radiator are made integral, the present invention may be applied solely to a single radiator.

In addition, as is clear from the aforesaid embodiments, when it is stated in this specification that "the sacrificial material is disposed inside the tank main body 234," it involves not only the disposition of the ingot Z of the sacrificial material inside the tank main body 234, as described in the second embodiment, but also the cladding of the core material with the corrosion preventing layer, as described in the first embodiment.

Note that while the present invention has been described with reference to the specific embodiments, those skilled in the art can change and modify them variously without departing from the scope and spirit of claims of the present invention.

What is claimed is:

1. A heat exchanger comprising:

a plurality of radiator tubes for allowing coolant to flow therethrough;

metallic radiator header tanks disposed at longitudinal ends of said plurality of tubes for communication with said tubes;

a plurality of radiator tubes for allowing refrigerant to flow therethrough; and metallic radiator header tanks disposed at longitudinal ends of said plurality of radiator tubes for communication with said tubes; wherein said radiator header tanks are each constituted by a radiator tank main body extending in a direction normal to a longitudinal direction of said radiator tubes and constituted by a plurality of members, at least one of said plurality of members being formed through extrusion or drawing and radiator caps for closing the longitudinal ends of said tank main body; wherein said metallic radiator header tanks are each constituted by a radiator tank main body extending in a direction normal to a longitudinal direction of said radiator tubes and radiator caps for closing the longitudinal ends of said radiator tank main body; wherein both said tank main bodies are made integrally with each other through extrusion or drawing; and wherein said radiator tank main bodies and said radiator caps are joined to each other through heat brazing with a sacrificial material comprising a metal having a lower electric potential than that of said radiator tank main body being disposed in the interior of said radiator tank main body.

2. A method for forming a corrosion preventing layer on internal surfaces of a metallic tank body, said method comprising:

providing a first metallic part having a sacrificial material disposed on a surface of said first part;

providing a second metallic part having no sacrificial material disposed on any surface of said second part;

joining said first and second metallic part to form said metallic tank body, said sacrificial material disposed on said surface of said first part being disposed within said metallic tank body; and coating a surface of said second metallic part with said sacrificial material by heating said sacrificial material, said surface of said second metallic part being disposed within said metallic tank body.

3. A method for forming a corrosion preventing layer on internal surfaces of a metallic tank main body which is filled with fluid; wherein said tank main body is constituted by at least two parts, at least one of said at least two parts being formed through extrusion or drawing and wherein at least one of said at least two parts has a sacrificial material disposed on an internal surface of said tank main body and the other part of said at least two parts having no sacrificial material are assembled together and said sacrificial material is heated in a state in which said sacrificial material is surrounded thereby.

4. A method for forming a corrosion preventing layer as set for the in claim 3, wherein said at least one part of said at least two parts where said sacrificial material is disposed is formed through press working, the other part being formed through extrusion or drawing.

5. A method for forming a corrosion preventing layer as set forth in claim 3; wherein said sacrificial material is heated at the same time as said two parts or said caps are brazed.

6. A method for forming a corrosion preventing layer as set forth in claim 3; wherein said sacrificial material is disposed by flame spraying a metal having a lower electric potential than that of said tank main body.

7. A method for forming a corrosion preventing layer as set forth in claim 3, wherein said tank main body is heated with a space within said tank main body being closed by closing the openings of the radiator tank main body with the radiator tank caps.

8. A method for forming a corrosion preventing layer as set forth in claim 3, wherein aluminum metal is used for said tank main body, and wherein, zinc is used as said metal having a lower electric potential than that of said tank main body.

9. A method for forming a corrosion preventing layer as set forth in claim 4, wherein said at least one part which has been formed through extrusion or drawing includes branch portions having a three-pronged shape.

* * * * *